US007163166B1

(12) United States Patent
Smith

(10) Patent No.: US 7,163,166 B1
(45) Date of Patent: Jan. 16, 2007

(54) ROTATABLE ASSEMBLY FOR MACHINES

(76) Inventor: Leward Nile Smith, Route 11, Box 3650, Lake City, FL (US) 32024-9358

( * ) Notice: Subject to any disclaimer, the term of this patent is extended or adjusted under 35 U.S.C. 154(b) by 105 days.

(21) Appl. No.: 11/044,516

(22) Filed: Jan. 27, 2005

Related U.S. Application Data

(60) Provisional application No. 60/558,053, filed on Mar. 31, 2004.

(51) Int. Cl.
*B02C 13/286* (2006.01)

(52) U.S. Cl. ..... 241/73; 241/70; 241/101.2

(58) Field of Classification Search ..... 241/101.2, 241/DIG. 38, 69, 70, 71, 72, 73, 189.1, 191
See application file for complete search history.

(56) References Cited

U.S. PATENT DOCUMENTS

| | | | |
|---|---|---|---|
| 190,675 | A | 5/1877 | Gaines |
| 589,236 | A | 8/1897 | Williams |
| 604,283 | A | 5/1898 | Albrecht |
| 787,290 | A | 4/1905 | Griffin |
| 1,266,894 | A | 5/1918 | Williams |
| 1,559,924 | A | 11/1925 | Willcox |
| 1,713,507 | A | 5/1929 | Ammon |
| 1,752,290 | A | 4/1930 | Ammon |
| 1,761,083 | A | 6/1930 | Liggett |
| 1,860,519 | A | 5/1932 | Wickersham |
| 1,889,129 | A | 11/1932 | Nielsen |
| 1,902,721 | A | 3/1933 | Reynolds |
| 2,026,790 | A | 1/1936 | Mankoff |
| 2,128,194 | A | 8/1938 | Sheldon et al. |
| 2,244,577 | A | 6/1941 | Schreiber |
| 2,318,219 | A | 5/1943 | Harris |
| 2,392,958 | A | 1/1946 | Tice |
| 2,663,505 | A | 12/1953 | Sennholtz |

(Continued)

FOREIGN PATENT DOCUMENTS

| | | |
|---|---|---|
| JP | 60-140645 | 9/1985 |

(Continued)

OTHER PUBLICATIONS

Wood Waste Disposal Problems: Bandit Has Some Answers!, Bandit Industries, Inc. Hard Hat News, Oct. 22, 1993. Bandit Industries, Inc., Reader Card 218, Forest Publications, Timber West, Nov. 1993.

(Continued)

*Primary Examiner*—Faye Francis
(74) *Attorney, Agent, or Firm*—Bliss McGlynn, P.C.

(57) ABSTRACT

A rotatable assembly for a machine includes a rotatable shaft having a longitudinal axis and a rotatable member disposed about the shaft. The rotatable assembly also includes at least one first connecting member operatively mounted to the rotatable member and to the shaft at a first location along the longitudinal axis of the shaft. The rotatable assembly includes at least one second connecting member operatively mounted to the rotatable member and located at a second location spaced from the first location along the longitudinal axis of the shaft. The rotatable assembly further includes a bearing operatively mounted to the shaft, wherein the second connecting member is operatively mounted to the bearing to allow the shaft to twist without permanent deformation when a concentrated load is subjected to the shaft as the rotor is rotated.

29 Claims, 7 Drawing Sheets

U.S. PATENT DOCUMENTS

| | | | |
|---|---|---|---|
| 2,705,596 | A | 4/1955 | Poyser |
| 2,710,635 | A | 6/1955 | Alexander |
| 2,863,476 | A | 12/1958 | Clark |
| 2,864,420 | A | 12/1958 | Schmidt |
| 2,900,069 | A | 8/1959 | Manns et al. |
| 3,035,682 | A | 5/1962 | Ferch |
| 3,194,543 | A | 7/1965 | McIlvaine |
| 3,203,532 | A | 8/1965 | Mimnaugh et al. |
| 3,254,687 | A | 6/1966 | Tertyshnikov |
| 3,367,585 | A | 2/1968 | Ratkowski |
| 3,436,028 | A | 4/1969 | Koehnen et al. |
| 3,509,924 | A | 5/1970 | Newhouse, Jr. |
| 3,642,214 | A | 2/1972 | Blackwell, Jr. |
| 3,844,494 | A | 10/1974 | Hightower |
| 3,907,016 | A | 9/1975 | Nicholson et al. |
| 4,000,859 | A | 1/1977 | Whitney |
| 4,060,961 | A | 12/1977 | Anderson et al. |
| 4,074,594 | A | 2/1978 | Dall et al. |
| 4,076,177 | A | 2/1978 | Hirayama et al. |
| 4,077,450 | A | 3/1978 | Ackerman |
| 4,077,573 | A | 3/1978 | Kersey et al. |
| 4,117,985 | A | 10/1978 | Lazareck |
| 4,129,260 | A | 12/1978 | Baker |
| 4,129,262 | A | 12/1978 | Lowry |
| 4,146,184 | A | 3/1979 | Whitney |
| 4,146,185 | A | 3/1979 | Schober |
| 4,162,769 | A | 7/1979 | Lapointe |
| 4,162,770 | A | 7/1979 | Lewis |
| 4,168,035 | A | 9/1979 | Palm et al. |
| 4,344,581 | A | 8/1982 | Redemann |
| 4,504,019 | A | 3/1985 | Newell et al. |
| 4,558,826 | A | 12/1985 | Martinek |
| 4,573,643 | A | 3/1986 | Orphall et al. |
| 4,688,731 | A | 8/1987 | Hunt et al. |
| 4,702,424 | A | 10/1987 | Widlak |
| 4,717,083 | A | 1/1988 | Quast et al. |
| 4,848,681 | A | 7/1989 | Eriksson et al. |
| 4,850,406 | A | 7/1989 | Krautzberger |
| 4,872,500 | A | 10/1989 | Duffey et al. |
| 4,915,310 | A | 4/1990 | Stelk |
| 4,917,314 | A | 4/1990 | Manschwetus |
| 4,922,977 | A | 5/1990 | Colton et al. |
| 4,967,969 | A | 11/1990 | Griffith, III |
| 4,982,904 | A | 1/1991 | Greiner |
| 5,002,233 | A | 3/1991 | Williams |
| 5,042,727 | A | 8/1991 | Plante |
| 5,044,567 | A | 9/1991 | Hausler et al. |
| 5,078,328 | A | 1/1992 | Willingham |
| 5,114,085 | A | 5/1992 | Inui |
| 5,205,496 | A | 4/1993 | O'Donnell et al. |
| 5,209,278 | A | 5/1993 | Carpenter et al. |
| 5,285,974 | A | 2/1994 | Cesarini |
| 5,372,316 | A | 12/1994 | Bateman |
| 5,377,919 | A | 1/1995 | Rogers et al. |
| 5,381,971 | A | 1/1995 | Rehmer |
| 5,392,999 | A | 2/1995 | Konig et al. |
| 5,404,993 | A | 4/1995 | Scarro |
| 5,413,286 | A | 5/1995 | Bateman |
| 5,435,689 | A | 7/1995 | Stonehouse |
| 5,474,239 | A | 12/1995 | Williams, Jr. et al. |
| 5,507,441 | A | 4/1996 | De Boef et al. |
| 5,526,988 | A | 6/1996 | Rine |
| 5,529,249 | A | 6/1996 | Braun et al. |
| 5,611,496 | A | 3/1997 | Fleenor |
| 5,713,525 | A | 2/1998 | Morey |
| 5,743,314 | A | 4/1998 | Puch |
| 5,863,003 | A | 1/1999 | Smith |
| 5,938,129 | A | 8/1999 | Forsyth |
| 6,016,979 | A | 1/2000 | Squires et al. |
| 6,047,912 | A | 4/2000 | Smith |
| 6,059,210 | A | 5/2000 | Smith |
| 6,299,082 | B1 | 10/2001 | Smith |
| 6,517,020 | B1 | 2/2003 | Smith |
| 6,845,931 | B1 | 1/2005 | Smith |
| 6,978,955 | B1 * | 12/2005 | Verhoef et al. ..... 241/223 |

FOREIGN PATENT DOCUMENTS

| | | |
|---|---|---|
| JP | 64-7960 | 1/1989 |
| JP | 1-65650 | 4/1989 |
| JP | 8-299825 | 11/1996 |

OTHER PUBLICATIONS

The Beast, Model 30 Grinding Yard Waste, Model 15, Grinding Housing Demolition, Waste Handling Equipment News, Sep. 1994.
Bandit's Beast Maintains Nature's Beauty, Construction Equipment Guide, Jun. 1, 1994.
Bandit Industries' Model 15-H Beast Recycler, Forest Products Equipment, Aug. 1994. The Model 15 Beast, Bandit Industries, Inc., MSW Management, Mar./Apr. 1994.
Want to Lower the Cost of Breaking Down Yard and Other Landfill Waste? . . . Try the Beast from Bandit, Resource Recycling, Nov. 1994. Turn Your Green Waste Into Green Dollars, Bandit Industries, Inc., Sportsurf, 1994.
"Product Release" for the new Model 15-H Beast Recycler Offered by Bandit Industries, Waste Handling Equipment New, Jun. 1994.
For Your Chipping and Grinding Needs, Bandit Industries, Inc., Forest Products Equipment, Aug. 1994.
Megagrind by Rexworks 800, 1995. How to chop yard waste costs?, 1000 Commercial Grinder, Farmhand. The Beast, Model 15-H, Bandit Industries, Inc.
The Beast Recyclers from Bandit Industries . . . with Big Appetites for Waste, Bandit Industries. The Beast-Coming in the Summer of 1993 from Bandit Industries, Inc., Bandit Insutries, Inc. Maxigrind by Rexworks, The Most Versatile Materials Processing Machine. Industrial Grinder, Big Bite, Manufactured by Haybuster.

* cited by examiner

ROTATABLE ASSEMBLY FOR MACHINES

CROSS-REFERENCE TO RELATED APPLICATION(S)

The present application claims the priority date of co-pending U.S. Provisional Patent Application Ser. No. 60/558,053, filed Mar. 31, 2004.

BACKGROUND OF THE INVENTION

1. Field of the Invention

The present invention relates generally to rotatable members for machines and, more particularly, to a rotatable assembly for a machine.

2. Description of the Related Art

It is known to provide a machine such as a waste processing machine to reduce waste material. The waste processing machine typically includes a rotatable assembly such as a rotor assembly. The rotor assembly generally includes a rotor and a plurality of processing tools attached to the rotor for reducing the waste material as the rotor rotates. An example of such a waste processing machine is disclosed in U.S. Pat. No. 5,863,003 to Smith. In that patent, the rotor assembly comprises a generally cylindrical rotor onto which a plurality of processing tools is mounted. The rotor is mounted to a coaxially disposed shaft by multiple plate-like braces extending tangentially from the outer surface of the shaft to the inner surface of the rotor. There are two sets of braces, and each set is attached at opposing ends of the rotor.

In operation, an engine operatively rotates the shaft, which causes the rotor to rotate. As waste material passes by the rotor, the processing tools attached to the rotor contact the waste material, cut or reduce the waste material, and expel the reduced waste material from the waste processing machine.

Rigid attachments, for example welds, join the individual braces to the rotor and shaft. When non-grindable materials, such as rocks and other hard debris, enter the waste processing machine, the processing tools are unable to break them down. Instead, when the processing tools impact the non-grindables, the impact force transfers through the rotor, through the braces, and into the shaft as a concentrated or shock load. More specifically, loading of the first and second sets of braces results in a torsional load and bending load in the same plane on the shaft. These combined loads can cause deformation or breakage of the drive end of the shaft, which renders it inoperable. Users can replace the shaft, but replacement typically costs a significant amount of money and machine downtime.

One attempt to solve this problem is to increase the diameter of the shaft. As such, the bulkier or larger diameter shaft can withstand higher stresses or concentrated loads, making it less likely to deform or break when the processing tools contact non-grindable material. However, the larger diameter shafts cost more to make, which is undesired. Moreover, increasing the diameter of the shaft does not ensure other components in the rotor assembly will withstand the high stresses caused by the non-grindables. For example, a belt typically drives the shaft during operation. When the processing tools impact the non-grindables, the resultant shock load may cause the belt to break, costing the user significant time and money for repair. Therefore, there is a need in the art for an assembly that can better withstand the high impact forces and concentrated loads.

SUMMARY OF THE INVENTION

Accordingly, the present invention is a rotatable assembly for a machine. The rotatable assembly includes a rotatable shaft having a longitudinal axis and a rotatable member disposed about the shaft. The rotatable assembly also includes at least one first connecting member operatively mounted to the rotatable member and to the shaft at a first location along the longitudinal axis of the shaft. The rotatable assembly includes at least one second connecting member operatively mounted to the rotatable member and located at a second location spaced from the first location along the longitudinal axis of the shaft. The rotatable assembly further includes a bearing operatively mounted to the shaft, wherein the second connecting member is operatively mounted to the bearing to allow the shaft to twist without permanent deformation when a concentrated load is subjected to the shaft as the rotatable member is rotated.

One advantage of the present invention is that a rotatable assembly is provided for a machine having a bearing that allows twisting of the shaft so that the shaft experiences less detrimental shock and concentrated loading. Another advantage of the present invention is that the rotatable assembly allows a diameter of a shaft to be reduced by keeping stress in a manageable range for the same deflection, thereby saving material and manufacturing costs. Yet another advantage of the present invention is that the rotatable assembly prevents concentrated stress from being in the same plane for torsion or bending. Still another advantage of the present invention is that the rotatable assembly has other components attached to the shaft, such as drive belts and the like, which last longer due to the reduced stress. A further advantage of the present invention is that the rotatable assembly increases the operating life of the shaft, lessening the expense and time of repairs to and replacement of the rotatable assembly.

Other objects, features, and advantages of the present invention will be readily appreciated, as the same becomes better understood, after reading the subsequent description when considered in connection with the accompanying drawings.

DESCRIPTION OF THE PREFERRED EMBODIMENT(S)

Figure 1:
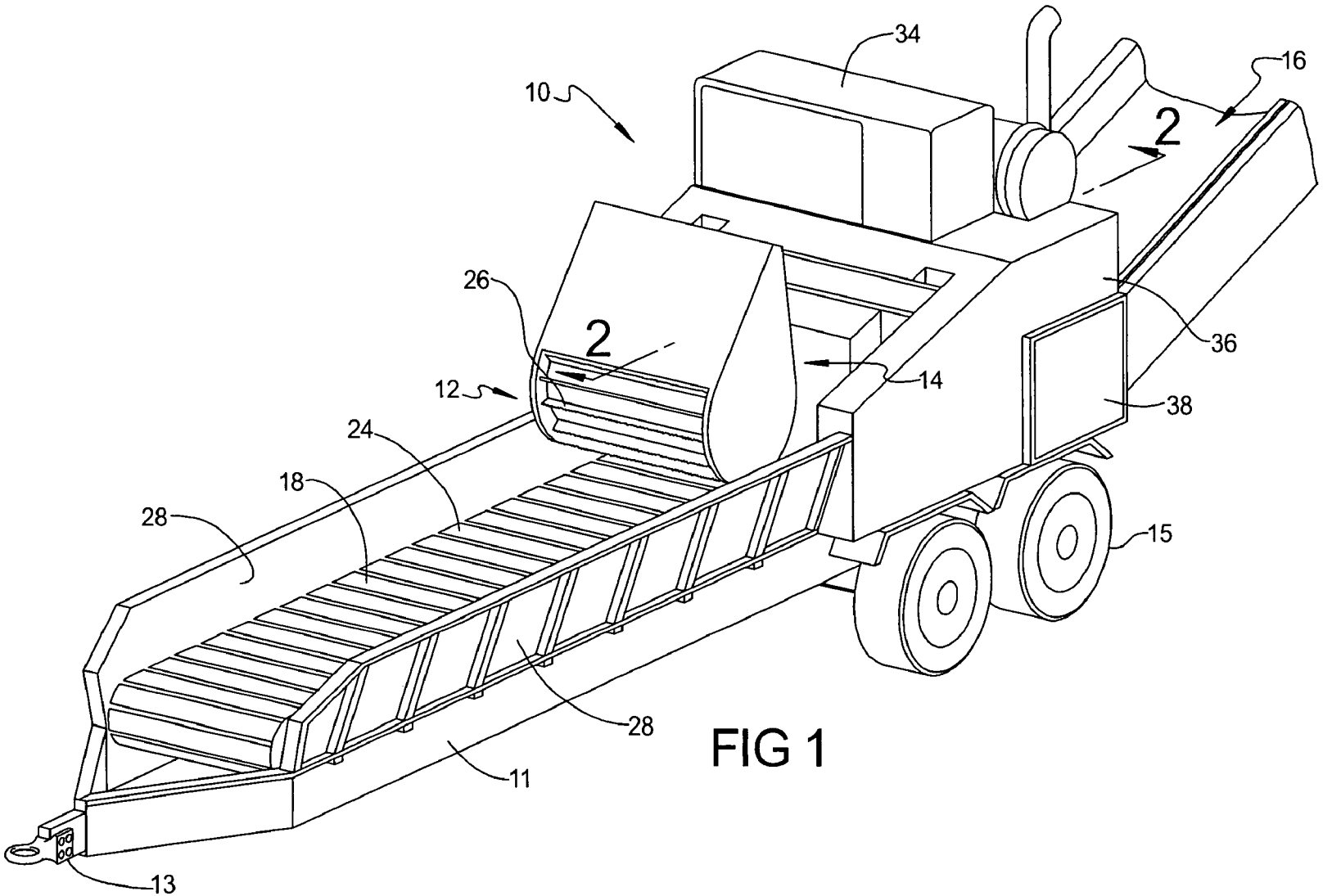
FIG. 1 is a perspective view of a waste processing machine.

Referring now to the drawings and in particular to FIG. 1, one embodiment of a machine such as a waste processing machine 10 is shown. The waste processing machine 10 includes an infeed system 12, a waste reducing system 14, and a discharge system 16. Waste material enters the waste processing machine 10 through the infeed system 12 where it is directed to the waste reducing system 14. The waste reducing system 14 reduces the waste material and directs it to the discharge system 16 where the reduced waste material is expelled from the waste processing machine 10. The waste processing machine 10 may be supported on a trailer framework 11 having a tongue mount 13 provided at a front thereof and wheels 15 near a rear of the framework 11. It should be appreciated that, with this structure, the infeed system 12 and waste reducing system 14 can be transported together while the discharge system 16 can be transported separately therefrom.

Figure 2:
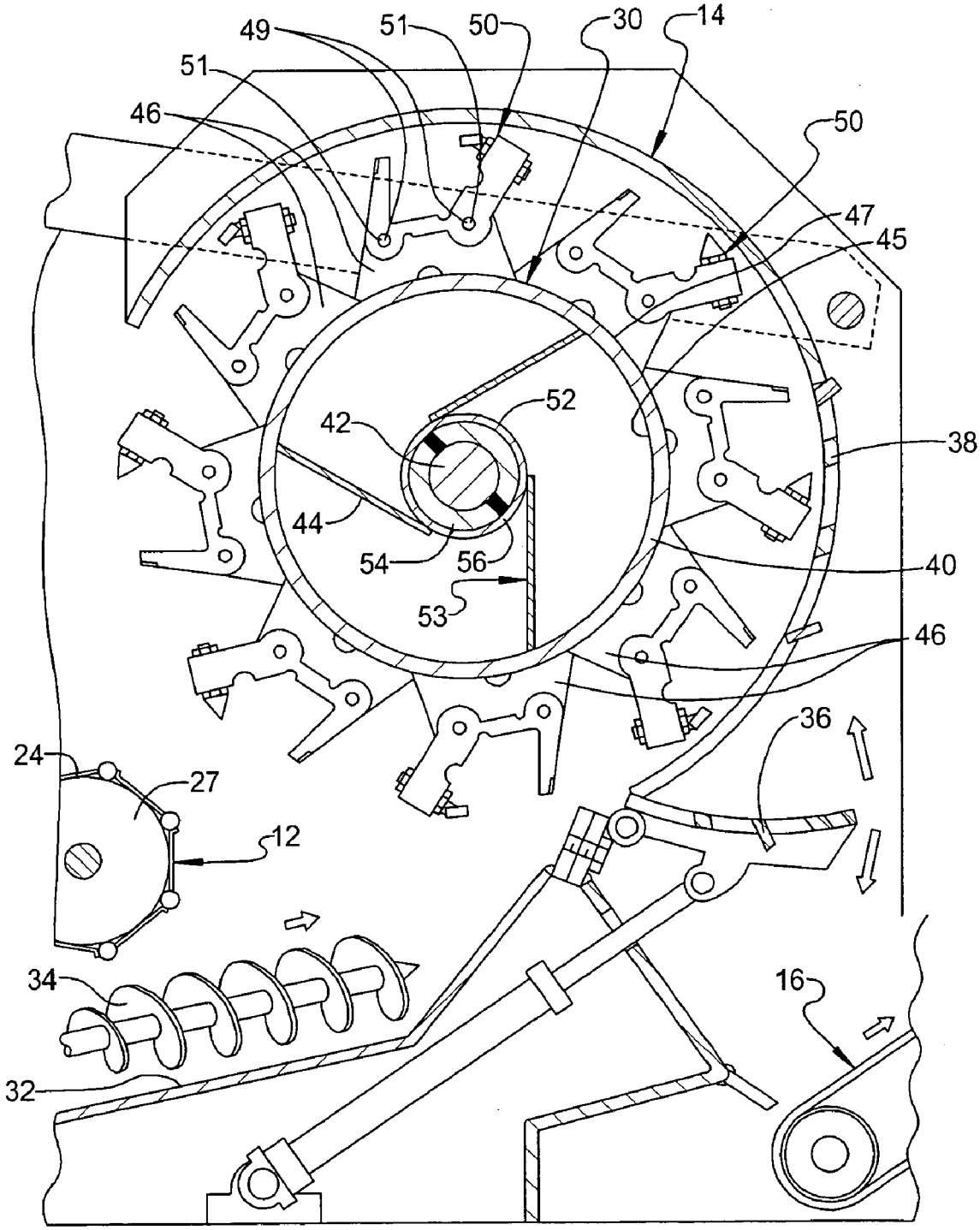
FIG. 2 is a sectional view taken along line 2—2 of FIG. 1.

Referring to FIGS. 1 and 2, the infeed system 12 includes an infeed conveyor 24 and a feed wheel assembly 26. Opposed side walls 28 are provided on opposite sides of the conveyor 24 to contain the waste material. It should be appreciated that waste material is placed on the infeed conveyor 24 which moves the waste material into contact with the feed wheel assembly 26 which, in turn, rolls the waste material through an inlet opening into contact with the waste reducing system 14.

Figure 3:
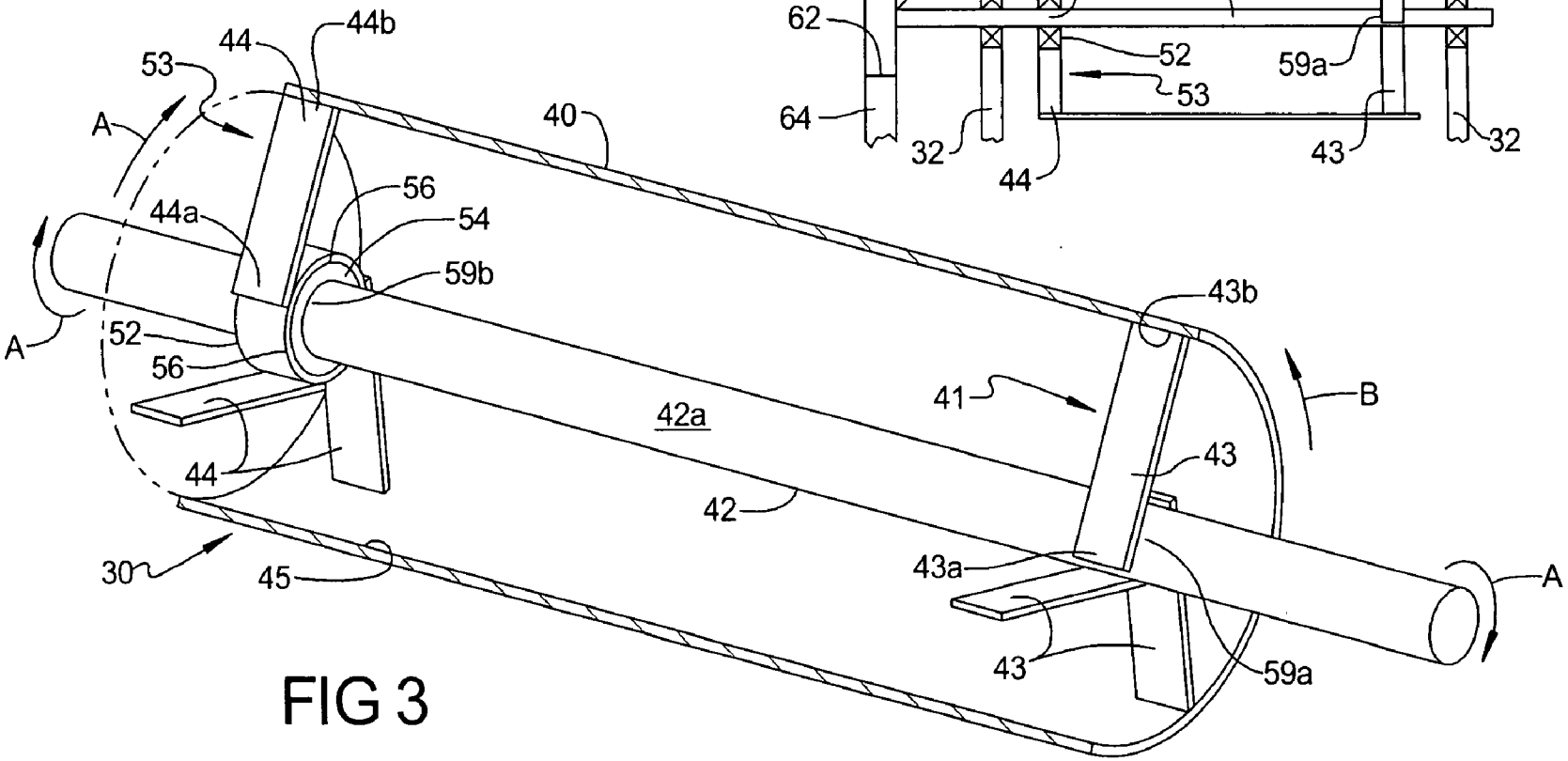
FIG. 3 is a perspective view of a rotor assembly, according to the present invention, of the waste processing machine of FIG. 1.

Referring to FIGS. 2 and 3, the waste reducing system 14 includes a rotatable assembly such as a rotor assembly, according to the present invention and generally indicated at 30. The waste reducing system 14 also includes a housing 32 disposed about the rotor assembly 30 and a plurality of regrind augers 34 positioned at a bottom of the housing 32. The waste reducing system 14 further includes a movable concave screen 36 and a fixed concave screen 38. It should be appreciated that the waste reducing system 14 reduces waste material by the rotor assembly 30, which passes through the screens 36, 38 to the discharge system 16. It should also be appreciated that the regrind augers 34 move reduced waste material into contact with the rotor assembly 30 for further reduction to ultimately pass through the screens 36,38.

Referring to FIGS. 2 through 5, one embodiment of the rotor assembly 30, according to the present invention, is shown. The rotor assembly 30 includes a rotatable member such as a rotor 40. The rotor 40 is a generally cylindrical tube having a longitudinal axis. The rotor assembly 30 includes a shaft 42 disposed coaxially to the rotor 40. The shaft 42 extends longitudinally and has a generally cylindrical shape with a longitudinal axis and a generally circular cross-sectional shape. The shaft 42 is solid. The shaft 42 is made of a metal material, preferably a 4140 heat-treated steel in one embodiment. The shaft 42 has a predetermined diameter such as five inches. It should be appreciated that the shaft 42 has a diameter less than a diameter of a shaft for conventional waste processing machines.

The rotor assembly 30 includes at least one, preferably a plurality of first connecting members, generally indicated at 41. The first connecting members 41 are operatively mounted to the rotor 40 and to the shaft 42 such that rotation of the shaft 42 causes rotation of the rotor 40. In the embodiment illustrated in FIGS. 2 through 5, each of the first connecting members 41 is a first brace 43 extending tangentially from an outer surface 42*a* of the shaft 42 to an inner surface 45 of the rotor 40. Preferably, each first brace 43 is an elongated plate-like member having a generally rectangular shape. The first brace 43 has a proximal end 43*a* and a distal end 43*b*. The proximal end 43*a* is fixed tangentially to the outer surface 42*a* of the shaft 42 by suitable means such as welding and the distal end 43*b* is similarly secured to the inner surface 45 of the rotor 40 by suitable means such as welding. It should be appreciated that the first braces 43 are spaced circumferentially about the shaft 42.

Additionally, the rotor assembly 30 includes at least one, preferably a plurality of second connecting members, generally indicated at 53. The second connecting members 53 are operatively mounted to the rotor 40 and extend toward the shaft 42. In the embodiment illustrated, each of the second connecting members 53 is a second brace 44. Preferably, each second brace 44 is an elongated plate-like member having a generally rectangular shape. The second brace 44 has a proximal end 44*a* and a distal end 44*b*. The distal end 44*b* is secured to the inner surface 45 of the rotor 40 by suitable means such as welding. The proximal end 44*a* is fixed tangentially to a bearing 52 to be described by suitable means such as welding. It should be appreciated that the first braces 44 are spaced circumferentially about the bearing 52. It should also be appreciated that, in the embodiment illustrated, three first braces 43 and three second braces 44 are illustrated, but in other embodiments, any number of first braces 43 or second braces 44 could be employed. It should further be appreciated that the rotor 40 and shaft 42 are coaxially aligned.

Figure 4:
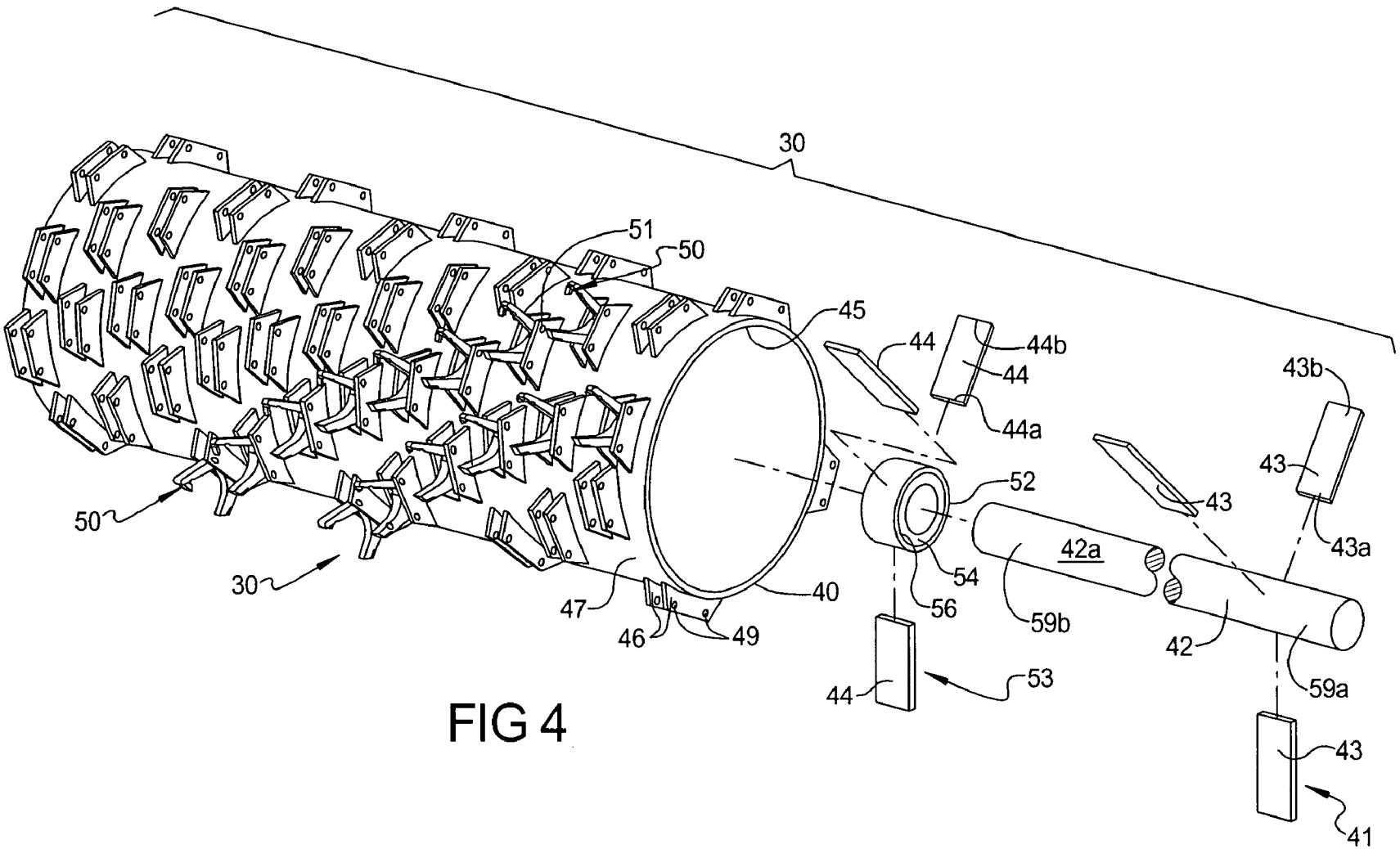
FIG. 4 is an exploded perspective view of a portion of the rotor assembly of FIG. 3.

As illustrated in FIGS. 2 and 4, the rotor assembly 30 includes a plurality of trapezoid-shaped mounting arms 46 attached to an outer surface 47 of the rotor 40. The mounting arms 46 are arranged into pairs, and axially aligned apertures 49 extend through each pair. As illustrated in FIG. 2, the rotor assembly 30 includes at least one, preferably a plurality of processing tools 50. Each of the processing tools 50 is attached to a pair of mounting arms 46 via a bolt 51 that extends through the respective pairs of apertures 49. It should be appreciated that the processing tools 50 reduce waste material when rotated by the rotor 40.

In one embodiment, the bearing 52 is of a plane bearing type having no rolling members. The plane bearing is a self-lubricating bearing. Preferably, the bearing 52 is a plastic laminate with a metal backing. In another embodiment, the bearing 52 has a suitable bearing structure such as a babbit and having no rolling members. In yet another embodiment, the bearing 52 is a bronze solid bearing having no rolling members. The bearing 52 is commercially available from Garlock Bearings Inc. The bearing 52 has at least one sleeve, preferably an inner sleeve 54 and an outer sleeve 56. The inner sleeve 54 is disposed about the shaft 42, and the second braces 44 are operatively mounted to the outer sleeve 56 by suitable means such as welding. It should be appreciated that the first braces 43 are operatively mounted to the shaft 42 at a first location 59*a* and the second braces 44 are operatively mounted to the outer sleeve 56 of the bearing 52 at a second location 59*b* spaced longitudinally from the first location 59*a* along the longitudinal axis of the shaft 42. It should also be appreciated that, as described in greater detail below, the bearing 52 allows the shaft 42 to twist without permanent deformation in response to a concentrated loading of the shaft 42. It should further be appreciated that, as described below in greater detail, the bearing 52 reduces stress on the shaft 42.

Figure 5:
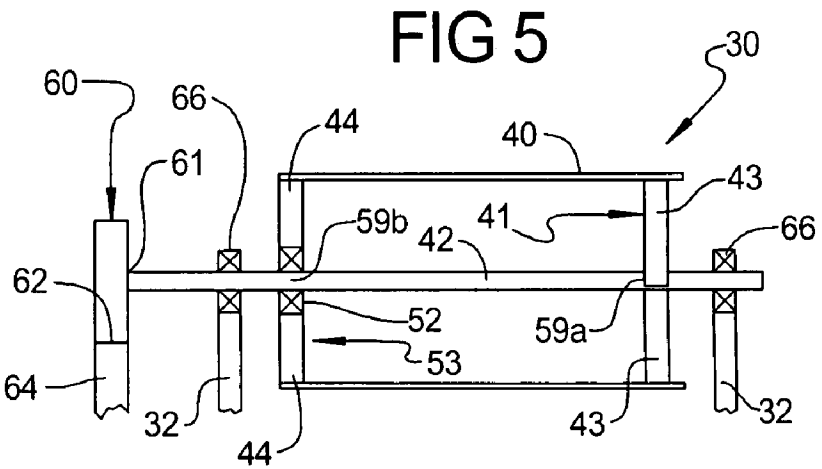
FIG. 5 is a fragmentary plan view of the rotor assembly of FIG. 3.

Referring to FIG. 5, the rotor assembly 30 also includes a drive assembly, generally indicated at 60, for rotating the shaft 42 about its longitudinal axis. The drive assembly 60 operatively connects the shaft 42 to a power source such as an engine (not shown). The drive assembly 60 is operatively mounted to the shaft 42 at a third location 61 along the longitudinal axis of the shaft 42. The second braces 44 are mounted to the bearing 52 at the second location 59*b*, and the second location 59*b* is disposed between first location 59*a*, where the first braces 43 are mounted to the shaft 42, and the third location 61, where the drive assembly 60 is mounted to the shaft 42. In one embodiment, the drive assembly 60 includes a pulley 62 connected to the shaft 42 and a drive belt 64 that wraps around the pulley 62 and another pulley (not shown) connected to the engine. The drive assembly 60 also includes at least one, preferably a plurality of, more preferably a pair of bearings 66 connected to the housing 32 to rotatably support the rotor assembly 30 upon the housing 32. It should be appreciated that, during operation, the engine advances the drive belt 64, which rotates the pulley 62 and the attached shaft 42.

In operation, the drive assembly 60 advances the drive belt 64, which rotates the pulley 62 and the attached shaft 42, which in turn rotates the rotor 40, in the direction of arrow A shown in FIG. 3. As waste material contacts the rotor assembly 30, the processing tools 50 attached to the rotor 40 strike and reduce the waste material, and push the reduced waste material toward the screens 36, 38 of the rotor assembly 30.

However, if one of the processing tools 50 impacts a non-grindable object, such as a rock, the impact force is transferred through the respective mounting arms 46 and into the rotor 40. The impact force or load in the rotor 40 is transferred through both the first and second braces 43 and 44 to the shaft 42 and the bearing 52, respectively. The force or load transferred directly to the shaft 42 impedes the rotation of the rotor 40 at the point of impact in the direction of arrow B. The force transferred into the second braces 44 merely transfers into the bearing 52, and the bearing 52 allows the second braces 44 to rotate relative to the shaft 42. The drive assembly 60 continues to drive or rotate the rotor 40 in the direction of arrow A. As such, the shaft 42 twists one end with respect to the other to allow the non-grindable object to pass the processing tools 50 and the shaft 42 returns back to its original state without breakage or deformation of the shaft 42.

In one example, the processing tools 50 can twist three to four inches while the shaft 42 twists one-quarter inches. The bearing 52 pushes over a large surface such that there is no concentrated load due to bending on the shaft 42 and the distance between the drive assembly 60 and the first braces 43 is relatively large such that there is no concentrated load due to torsion. As such, the stress cannot be concentrated in the same plane for torsion and bending.

Advantageously, the shaft 42 is less likely to deform because one end can twist relative to the other without permanent deformation. As a result, the diameter of the shaft 42 can be reduced without significantly reducing its operating life. This saves on manufacturing and replacement costs. Also, the components of the drive assembly 60 that are attached to the shaft 40 last longer due to the reduced stress on the shaft 40.

Figure 6:
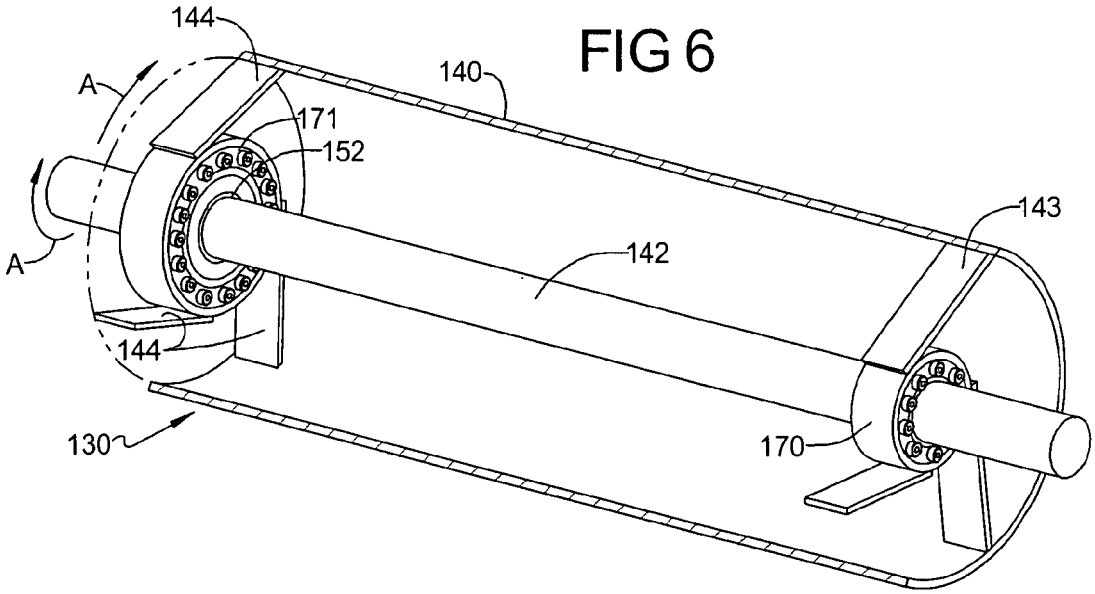
FIG. 6 is a partial fragmentary perspective view of another embodiment, according to the present invention, of the rotor assembly of FIG. 1.

Referring to FIG. 6, another embodiment, according to the present invention, of the rotor assembly 30 is shown. Like parts of the rotor assembly 30 have like reference numerals increased by one hundred (100). In this embodiment, the rotor assembly 130 includes the rotor 140, shaft 142, first braces 143, second braces 144, and bearing 152. The rotor assembly 130 also includes at least one, preferably a first keyless locking device 170 and a second keyless locking device 171. The locking devices 170, 171 can be any suitable known keyless locking device known in the art, such as those known as "B-LOC" and commercially available from Detroit Gear Works. The first braces 143 are each operatively mounted to the first keyless locking device 170 such as by welding, and the first keyless locking device 170 is locked on the shaft 142 in a known manner. As such, the first keyless locking device 170 operatively mounts the first braces 143 to the shaft 142. The second braces 144 are each operatively mounted to the second keyless locking device 171 such as by welding, and the second keyless locking device 171 is locked on the bearing 152 in a known manner. As such, the second keyless locking device 171 operatively mounts the second braces 144 to the bearing 152. The operation of the rotor assembly 130 is similar to the rotor assembly 30. The first and second keyless locking devices 170, 171 provide a convenient means of assembling and disassembling the rotor assembly 130. It should be appreciated that the rotor assembly 130 could include only the first keyless locking device 170 and the second braces 144 could be directly mounted to the bearing 152. It should also be appreciated, that the rotor assembly 130 could include only the second keyless locking device 171 and the first braces 143 could be directly mounted to the shaft 142.

Figure 7:
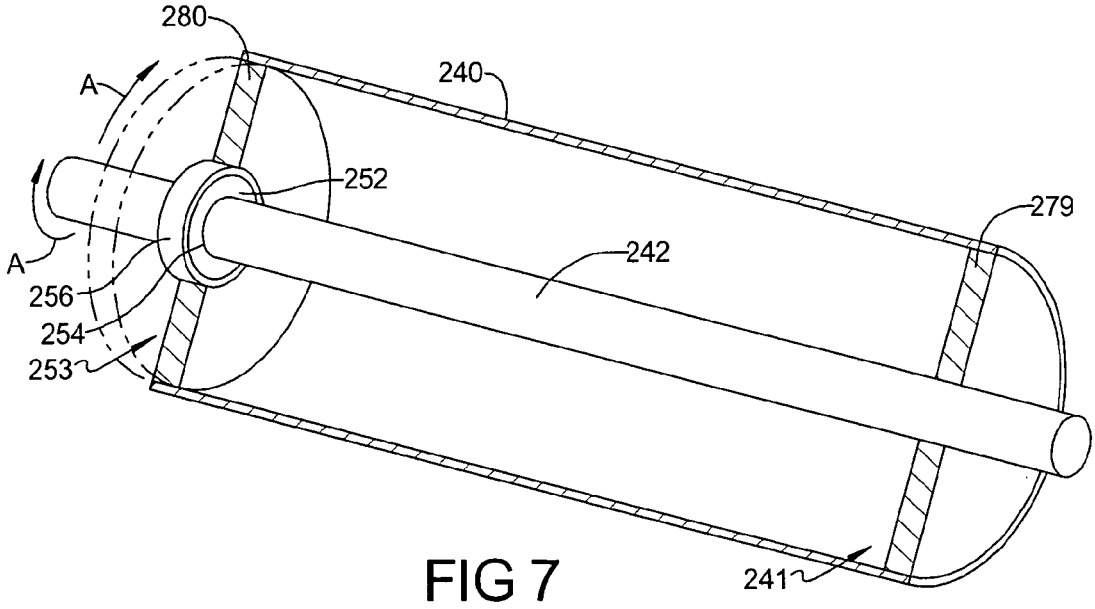
FIG. 7 is a partial fragmentary perspective view of yet another embodiment, according to the present invention, of the rotor assembly of FIG. 1.

Referring to FIG. 7, yet another embodiment, according to the present invention, of the rotor assembly 30 is shown. Like parts of the rotor assembly 30 have like reference numerals increased by two hundred (200). In this embodiment, the rotor assembly 230 includes the rotor 240, shaft 242, first connecting member 241, second connecting member 253, and bearing 252. However, in this embodiment, the first connecting member 241 is a circular first disk 279 disposed about and operatively mounted to the shaft 242 and operatively mounted to the rotor 240. Similarly, the second connecting member 253 is a circular second disk 280 disposed about and operatively mounted to the bearing 252 and operatively mounted to the rotor 240. In one embodiment, the first disk 279 is welded to the shaft 242 and the rotor 240, and the second disk 280 is welded to the bearing 252 and the rotor 240. The operation of the rotor assembly 230 is similar to the rotor assembly 30. It should be appreciated that the disk 280 may be solid or have open portions therein. It should also be appreciated that the rotor assembly 230 may include only the first disk 279 and any other suitable second connecting member 253. It should further be appreciated that the rotor assembly 230 may include only the second disk 280 and any other suitable first connecting member 241.

Figure 8:
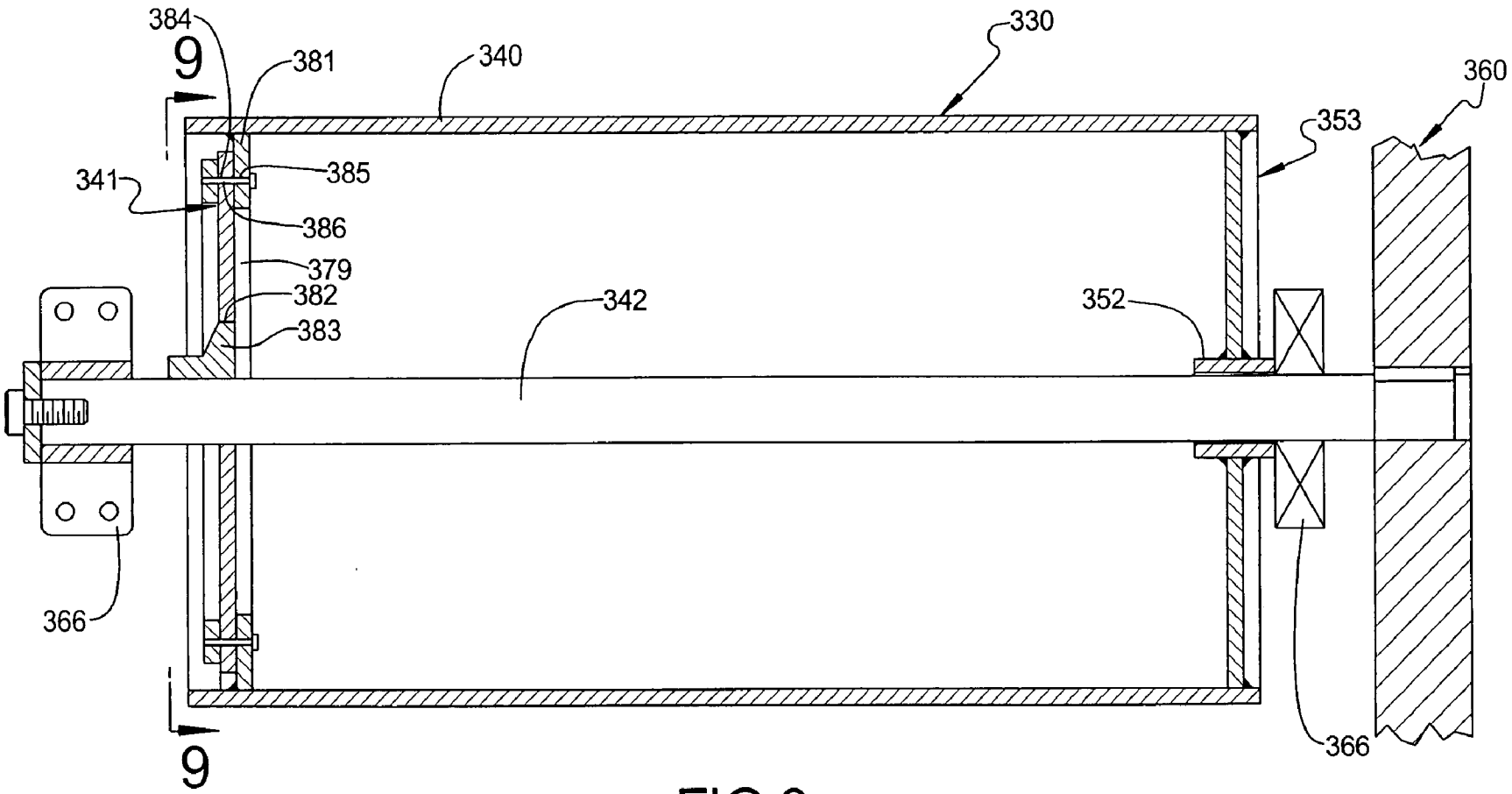
FIG. 8 is a fragmentary plan view of still another embodiment, according to the present invention, of the rotor assembly of FIG. 1.
Figure 9:
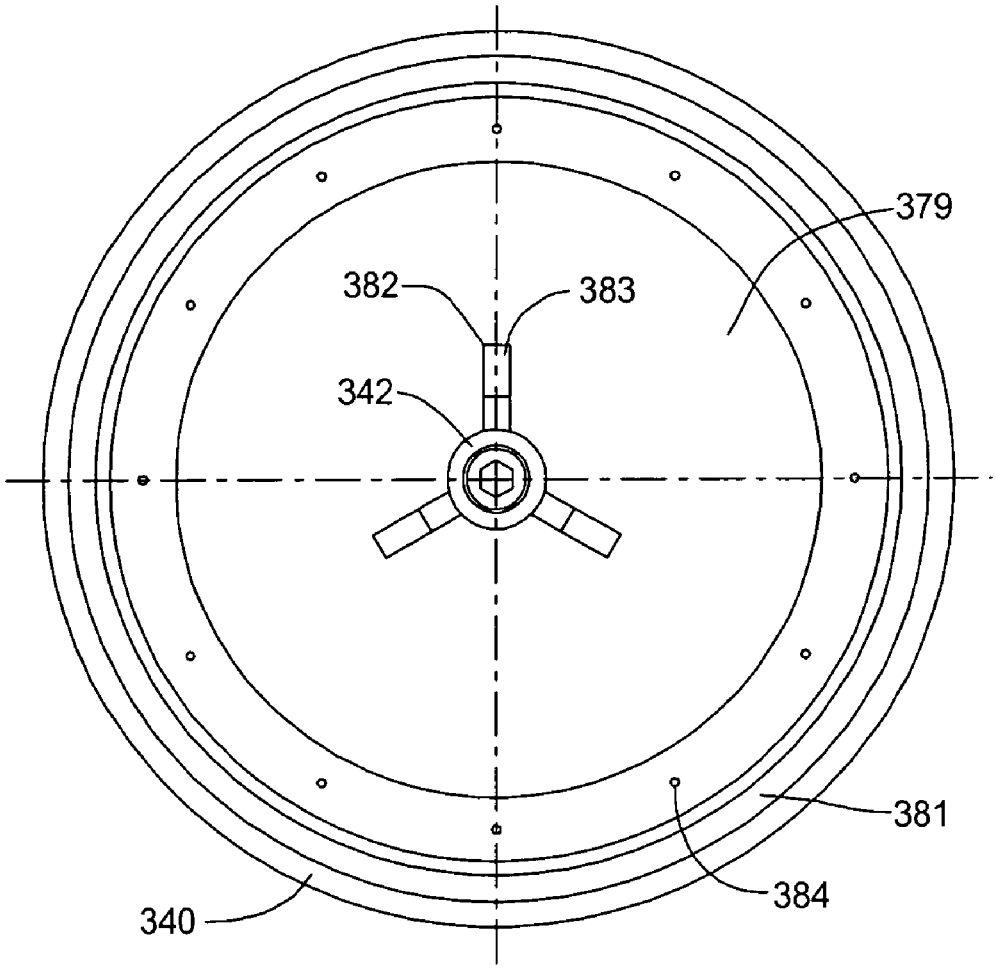
FIG. 9 is an elevational view of the rotor assembly of FIG. 8.

Referring to FIGS. 8 and 9, still another embodiment, according to the present invention, of the rotor assembly 30 is shown. Like parts of the rotor assembly 30 have like reference numerals increased by three hundred (300). In this embodiment, the rotor assembly 330 includes the rotor 340, shaft 342, and bearing 352. The rotor assembly 330 also includes the drive assembly 360 with bearings 366 similar to the rotor assembly 30 illustrated in FIG. 5. One of the bearings 366 is positioned directly adjacent the bearing 352, and the other bearing 366 is positioned directly adjacent the first connecting member 341. The other bearing 366 has a bearing mount 366*a* locked in place by a washer 366*b* and a threaded fastener 366*c* that extends through the washer 366*b* and threadably engages a threaded aperture 366*d* in the shaft 342. It should be appreciated that the bearing 366 is locked in place such that the proper longitudinal position of the shaft 342 and rotor 340 can be achieved more easily.

Also, the rotor assembly 330 includes the first and second connecting members 341 and 353. The second connecting member 353 may include the second braces 44 of FIGS. 2 through 5, the second disk 280 of FIG. 7, or any other suitable second connecting member 353. However, in the embodiment illustrated in FIGS. 8 and 9, the second connecting member 353 is a disk 380 connected to the rotor 340 and bearing 352 by a suitable mechanism such as welding.

Referring to FIGS. 8 and 9, the rotor assembly 330 includes the first connecting member 341 releasably mounted to the rotor 340. The first connecting member 341 includes a circular disk 379 having at least one, preferably a plurality of slots 382. The slots 382 are spaced circumferentially and are generally rectangular in shape. The disk 379 also has at least one, preferably a plurality of apertures 384 spaced circumferentially and arranged in a circular pattern near the outer radial edge of the disk 379. The apertures 384 are generally circular in shape. The disk 379 is made of a metal material.

The rotor assembly 330 includes at least one, preferably a plurality of gussets 383. One of the gussets 383 is positioned within one of slots 382. The gussets 383 are made of a metal material. The gussets 383 are mounted and secured to the shaft 342 and the disk 379 by a suitable mechanism such as welding.

The rotor assembly 330 further includes a ring 381 disposed about the inner surface 345 of the rotor 340. The ring 381 includes at least one, preferably a plurality of apertures 385 spaced circumferentially and arranged in a pattern corresponding to that of the apertures 384 of the disk 379. The ring 381 is made of a metal material. The ring 381 is mounted and secured to the inner surface 345 of the rotor 340 by a suitable mechanism such as welding. The ring 381 extends radially inward toward the shaft 342. The disk 379 and the ring 381 are axially aligned and each aperture 384 of the disk 379 is aligned with a corresponding aperture 385 of the ring 381.

The rotor assembly 330 includes the disk 379 releasably mounted to the ring 381. The rotor assembly 330 includes at least one, preferably a plurality of fasteners 386 extending through the apertures 384 and 385. The fasteners 386 are of a knurled wheel stud type (Part No. 610-209) and of a wheel nut type (Part No. 611-028) commercially available from Dorman. The nuts preferably have a chamfer. It should be appreciated that the apertures 385 in the ring 381 are accurate enough to hold a wheel lug without machining costs and have a tolerance of 0.005 inches to locate the shaft 342 on center. It should also be appreciated that the rotor assembly 330 of FIGS. 8 and 9 can be assembled and disassembled relatively quickly and easily by the fasteners 386.

Accordingly, the rotor assembly 30, 130, 230, 330 of the present invention has a bearing 52, 152, 252, 352 that allows twisting of the shaft 40, 140, 240, 340 so that the shaft 40, 140, 240, 340 experiences less detrimental shock and concentrated loading. The rotor assembly 30, 130, 230, 330 allows the diameter of the shaft 40, 140, 240, 340 to be reduced because stress on the shaft 40, 140, 240, 340 is relatively low, thereby saving material and manufacturing costs. The rotor assembly 30, 130, 230, 330 also prevents concentrated stress from being in the same plane for torsion or bending. Also, other components of the drive assembly that are attached to the shaft 40, 140, 240, 340, such as drive belts and the like, last longer due to the reduced stress. As a result, the rotor assembly 30, 130, 230, 330 has an increased operating life, thereby lessening repair time and expense. It should be appreciated that the diameter of the shaft controls cost of bearing.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A rotatable assembly for a machine comprising:

a rotatable shaft having a longitudinal axis;

a rotatable member disposed about said shaft;

at least one first connecting member operatively mounted to said rotatable member and to said shaft at a first location along the longitudinal axis of said shaft;

at least one second connecting member operatively mounted to said rotatable member and located at a second location spaced from the first location along the longitudinal axis of said shaft; and a bearing operatively mounted to said shaft, wherein said at least one second connecting member is operatively mounted to said bearing, said bearing allowing said at least one second connecting member to rotate relative to said shaft to allow said shaft to twist without permanent deformation when a concentrated load is subjected to said shaft as the rotatable member is rotated.

2. A rotatable assembly as set forth in claim 1 wherein said bearing is a plane bearing.

3. A rotatable assembly as set forth in claim 2 wherein said bearing is a plastic laminate.

4. A rotatable assembly as set forth in claim 1 wherein said bearing includes an inner sleeve disposed about said shaft and an outer sleeve disposed about said inner sleeve, and wherein said at least one second connecting member is operatively mounted to said outer sleeve.

5. A rotatable assembly as set forth in claim 1 wherein said at least one first connecting member is a brace extending generally tangentially from said shaft.

6. A rotatable assembly as set forth in claim 1 further including a first locking device operatively mounted to said at least one first connecting member and to said shaft.

7. A rotatable assembly as set forth in claim 1 wherein said at least one second connecting member is a brace extending generally tangentially from said bearing.

8. A rotatable assembly as set forth in claim 1 including a second locking device operatively mounted to said at least one second connecting member and to said bearing.

9. A rotatable assembly as set forth in claim 1 wherein said shaft has a solid cylindrical shape.

10. A rotatable assembly as set forth in claim 1 including a drive assembly for rotating said shaft, said drive assembly being operatively mounted to said shaft at a third location along the longitudinal axis of said shaft, wherein the second location is disposed between said first location and said third location along the longitudinal axis of said shaft.

11. A rotatable assembly for a machine comprising:

a rotatable shaft having a longitudinal axis;

a rotatable member disposed about said shaft;

at least one first connecting member operatively mounted to said rotatable member and to said shaft at a first location along the longitudinal axis of said shaft;

at least one second connecting member operatively mounted to said rotatable member and located at a second location spaced from the first location along the longitudinal axis of said shaft;

a bearing operatively mounted to said shaft, wherein said at least one second connecting member is operatively mounted to said bearing to allow said shaft to twist without permanent deformation when a concentrated load is subjected to said shaft as the rotatable member is rotated; and wherein said at least one first connecting member is a circular disk disposed about said shaft.

12. A rotatable assembly as set forth in claim 1 wherein said at least one first connecting member is releasably mounted to said rotatable member.

13. A rotatable assembly for a machine comprising:

a rotatable shaft having a longitudinal axis;

a rotatable member disposed about said shaft;

at least one first connecting member operatively mounted to said rotatable member and to said shaft at a first location along the longitudinal axis of said shaft;

at least one second connecting member operatively mounted to said rotatable member and located at a second location spaced from the first location along the longitudinal axis of said shaft;

a bearing operatively mounted to said shaft, wherein said at least one second connecting member is operatively mounted to said bearing to allow said shaft to twist without permanent deformation when a concentrated load is subjected to said shaft as the rotatable member is rotated; and a ring supported by an inner surface of said rotatable member.

14. A rotatable assembly as set forth in claim 13 wherein said at least one first connecting member is a circular disk that is releasably mounted to said ring.

15. A rotatable assembly for a machine comprising:

a rotatable shaft having a longitudinal axis;

a rotatable member disposed about said shaft;

at least one first connecting member operatively mounted to said rotatable member and to said shaft at a first location along the longitudinal axis of said shaft;

at least one second connecting member operatively mounted to said rotatable member and located at a second location spaced from the first location along the longitudinal axis of said shaft;

a bearing operatively mounted to said shaft, wherein said at least one second connecting member is operatively mounted to said bearing to allow said shaft to twist without permanent deformation when a concentrated load is subjected to said shaft as the rotatable member is rotated; and wherein said at least one second connecting member is a circular disk disposed about said bearing.

16. A rotor assembly for a waste processing machine comprising:

a rotatable shaft having a longitudinal axis;

a rotor disposed about said shaft including at least one processing tool adapted for reducing waste material;

at least one first connecting member operatively mounted to said rotor and to said shaft at a first location along the longitudinal axis of said shaft;

at least one second connecting member operatively mounted to said rotor and located at a second location spaced from the first location along the longitudinal axis of said shaft; and a bearing operatively mounted to said shaft, wherein said at least one second connecting member is operatively mounted to said bearing, said bearing allowing said at least one second connecting member to rotate relative to said shaft to allow said shaft to twist without permanent deformation when a concentrated load is subjected to said shaft as said rotor is rotated.

17. A rotor assembly as set forth in claim 16 wherein said bearing is a plane bearing.

18. A rotor assembly as set forth in claim 16 wherein said bearing is a plastic laminate.

19. A rotor assembly as set forth in claim 16 wherein said bearing includes an inner sleeve disposed about said shaft and an outer sleeve disposed about said inner sleeve, and wherein said at least one second connecting member is operatively mounted to said outer sleeve.

20. A rotor assembly as set forth in claim 16 wherein said at least one first connecting member is a brace extending generally tangentially from said shaft.

21. A rotor assembly as set forth in claim 16 wherein said at least one first connecting member is releasably mounted to said rotor.

22. A rotor assembly as set forth in claim 21 wherein said at least one first connecting member is a circular disk releasably mounted to said ring.

23. A rotor assembly as set forth in claim 16 including a first locking device operatively mounted to said at least one first connecting member and to said shaft.

24. A rotor assembly as set forth in claim 16 wherein said at least one second connecting member is a brace extending generally tangentially from said bearing.

25. A rotor assembly as set forth in claim 16 including a second locking device operatively mounted to said at least one second connecting member and to said bearing.

26. A rotor assembly for a waste processing machine comprising:

a rotatable shaft having a longitudinal axis;

a rotor disposed about said shaft including at least one processing tool adapted for reducing waste material;

at least one first connecting member operatively mounted to said rotor and to said shaft at a first location along the longitudinal axis of said shaft;

at least one second connecting member operatively mounted to said rotor and located at a second location spaced from the first location along the longitudinal axis of said shaft;

a bearing operatively mounted to said shaft, wherein said at least one second connecting member is operatively mounted to said bearing to allow said shaft to twist without permanent deformation when a concentrated load is subjected to said shaft as said rotor is rotated; and wherein said at least one first connecting member is a circular disk disposed about said shaft.

27. A rotor assembly for a waste processing machine comprising:

a rotatable shaft having a longitudinal axis;

a rotor disposed about said shaft including at least one processing tool adapted for reducing waste material;

at least one first connecting member operatively mounted to said rotor and to said shaft at a first location along the longitudinal axis of said shaft;

at least one second connecting member operatively mounted to said rotor and located at a second location spaced from the first location along the longitudinal axis of said shaft;

a bearing operatively mounted to said shaft, wherein said at least one second connecting member is operatively mounted to said bearing to allow said shaft to twist without permanent deformation when a concentrated load is subjected to said shaft as said rotor is rotated; and a ring mounted to an inner surface of said rotor.

28. A rotor assembly for a waste processing machine comprising:

a rotatable shaft having a longitudinal axis;

a rotor disposed about said shaft including at least one processing tool adapted for reducing waste material;

at least one first connecting member operatively mounted to said rotor and to said shaft at a first location along the longitudinal axis of said shaft;

at least one second connecting member operatively mounted to said rotor and located at a second location spaced from the first location along the longitudinal axis of said shaft;

a bearing operatively mounted to said shaft, wherein said at least one second connecting member is operatively mounted to said bearing to allow said shaft to twist without permanent deformation when a concentrated load is subjected to said shaft as said rotor is rotated; and wherein said at least one second connecting member is a circular disk that is disposed about said bearing.

29. A waste processing machine comprising:

a rotatable shaft having a longitudinal axis;

a rotor disposed about said shaft and including at least one processing tool adapted for reducing waste material;

at least one first connecting member operatively mounted to said rotor and to said shaft at a first location along the longitudinal axis of said shaft;

at least one second connecting member operatively mounted to said rotor and located at a second location spaced from the first location along the longitudinal axis of said shaft; and a bearing operatively mounted to said shaft, wherein said at least one second connecting member is operatively mounted to said bearing, said bearing allowing said at least one second connecting member to rotate relative to said shaft to allow said shaft to twist without permanent deformation when a concentrated load is subjected to said shaft as said rotor is rotated.

* * * * *